US007993743B2

(12) United States Patent
Taylor

(10) Patent No.: US 7,993,743 B2
(45) Date of Patent: Aug. 9, 2011

(54) STOPPERS COMPRISING A CORK SUBSTRATE AND A COMPOSITE BARRIER LAYER COMPRISING REACTIVE HOT MELT POLYURETHANE ADHESIVE

(75) Inventor: David Graham Taylor, Rudewick (GB)

(73) Assignee: Bacchus Technologies Ltd., Horsham, West Sussex (GB)

( * ) Notice: Subject to any disclaimer, the term of this patent is extended or adjusted under 35 U.S.C. 154(b) by 893 days.

(21) Appl. No.: 10/506,843

(22) PCT Filed: Mar. 6, 2003

(86) PCT No.: PCT/GB03/00939

§ 371 (c)(1),
(2), (4) Date: May 31, 2005

(87) PCT Pub. No.: WO03/074379

PCT Pub. Date: Sep. 12, 2003

(65) Prior Publication Data

US 2006/0035074 A1 Feb. 16, 2006

(30) Foreign Application Priority Data

| | | |
|---|---|---|
| Mar. 6, 2002 | (GB) | 0205543.2 |
| Sep. 30, 2002 | (GB) | 0222543.1 |
| Sep. 30, 2002 | (GB) | 0222544.9 |

(51) Int. Cl.
*B65D 39/00* (2006.01)
*B32B 7/02* (2006.01)

(52) U.S. Cl. ..... 428/334; 428/332; 428/339; 428/423.1; 428/425.1; 215/200; 215/261; 215/355; 215/364

(58) Field of Classification Search ..... None
See application file for complete search history.

(56) References Cited

U.S. PATENT DOCUMENTS

| | | | | |
|---|---|---|---|---|
| 3,821,135 | A * | 6/1974 | King | 524/16 |
| 4,745,014 | A * | 5/1988 | Hanaya et al. | 428/34.9 |
| 5,018,337 | A | 5/1991 | Carter et al. | |
| 5,527,580 | A | 6/1996 | Ikeda et al. | |
| 6,152,966 | A * | 11/2000 | Conrad et al. | 8/111 |
| 2003/0114626 | A1 * | 6/2003 | Franken et al. | 528/44 |

FOREIGN PATENT DOCUMENTS

| | | | |
|---|---|---|---|
| DE | 889 221 | | 9/1953 |
| DE | 1 942 494 | | 3/1971 |
| DE | 39 40 461 | A1 | 6/1991 |
| DE | 42 25 092 | A1 | 2/1993 |
| EP | 0 205 312 | A1 | 12/1986 |
| EP | 0 629 659 | A1 | 12/1994 |
| EP | 0 927 613 | A2 | 7/1999 |
| EP | 1 270 703 | A2 | 1/2003 |
| FR | 1 022 562 | | 3/1953 |
| JP | 05-031831 | | 2/1993 |
| PT | 95 130 | | 2/1992 |
| WO | WO 9628378 | A1 * | 9/1996 |
| WO | WO 96/34806 | | 11/1996 |
| WO | WO 00/64647 | | 11/2000 |
| WO | WO 00/64649 | | 11/2000 |
| WO | WO0064647 | A1 * | 11/2000 |
| WO | WO 03/004367 | A1 | 1/2003 |

* cited by examiner

*Primary Examiner* — Monique R Jackson
(74) *Attorney, Agent, or Firm* — Smith Gambrell & Russell LLP

(57) ABSTRACT

A stopper, particularly for a wine bottle, comprising a barrier layer comprising a hot melt polymetric adhesive and optionally at least one sub-layer having lower oxygen permeability than the hot melt adhesive.

14 Claims, 1 Drawing Sheet

Figure 1:
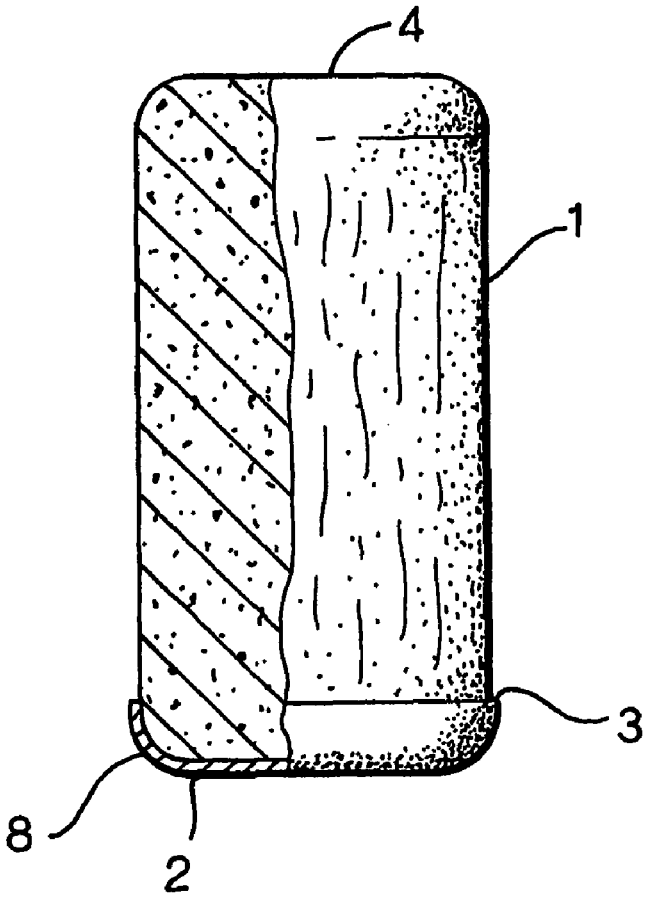

STOPPERS COMPRISING A CORK SUBSTRATE AND A COMPOSITE BARRIER LAYER COMPRISING REACTIVE HOT MELT POLYURETHANE ADHESIVE

The present invention relates to stoppers. More particularly, it relates to stoppers for bottles, particularly wine bottles. In the wine trade, these stoppers are commonly referred to as closures.

For ease of reference, the discussion of the present invention will be directed to stoppers for wine bottles, however, it will be understood that the terms "stopper" and "stoppers" should not be construed in a limited manner but should be construed as encompassing any stopper which may be inserted into a receptacle to close an opening in the receptacle. The receptacle may be suitable for containing any material such as wine, other beverages, sauces, oils, condiments, toiletries, cosmetics, dry ingredients and the like.

Stoppers made from cork obtained from the cork oak have traditionally been used to close bottles such as wine bottles. In use, the cork is inserted into the neck of the bottle where its inherent elasticity enables it to expand to seal the neck such that the ingress of air is reduced and the contents of the bottle are prevented from escaping from the wine.

More recently alternatives to natural cork have been sought. One suggestion, is to reconstitute natural corks either alone or including plastics material. One alternative solution is to produce a stopper wholly from plastics material. In general, such stoppers are produced to resemble the natural corks in colour such that they have a higher acceptability to the consumer. Typically, the stoppers are made from plastics such as polypropylene, polyethylene or vinyl acetate. These elastomers are generally melted, mixed with blowing agents such that a foam is formed and then injection moulded or extruded into the desired shape. Examples of synthetic closures can be found in, for example, WO 96/34806 which is incorporated herein by reference.

Synthetic stoppers can also be made of foamed resins such as polystyrene whether alone or in combination with other compounds such as butadiene. These are manufactured by injecting beads of expandable polystyrene, which contain blowing agents such as pentane, into a mould. Steam is then injected into the mould to cause the beads to swell. As they swell, they stick together and take the shape of the mould. The use of a foamed material has an advantage as the foamed core of the synthetic stopper provides it with some elasticity to aid insertion.

Whilst these synthetic stoppers go some way to providing acceptable closure of bottles, a comparative trial of synthetic stoppers versus cork, which was run by the Australian Wine Research Institute and published in the Australian Journal of Grape and Wine Research in 2001, showed that in general, synthetic stoppers do not fully reproduce the sealing capabilities of cork. In particular, the wine bottled with synthetic stoppers tended to oxidize faster than that bottled with corks. This is believed to be due to the penetration of oxygen along the interface between the synthetic closure and the wall of the bottle.

Whilst conventionally it has been believed that the problem was at the interface, we have now found that surprisingly oxygen can also pass through the body of the synthetic stopper. Whilst the rate of oxygen penetration through the stopper is small, over time it becomes significant such that the wine will oxidise.

Whilst not wishing to be bound by any particular theory, it is believed that the polymer chains which are used to form the plastics stoppers are relatively large molecules, they pack and/or fold in such a manner that small spaces are left through which the relatively small oxygen molecules can pass. This is particularly the case where the core of the synthetic stopper is foamed such that there are voids present through which the oxygen can readily pass.

Different plastics materials have different rates of permeability to oxygen. The permeability rates for plastics materials commonly found in synthetic stoppers are as follows:

| | |
|---|---|
| Polystyrene | 933 $cm^3m^{-2}day^{-1}$ |
| Polypropylene | 1952 $cm^3m^{-2}day^{-1}$ |
| Polyethylene | 4669 $cm^3m^{-2}day^{-1}$ |

Whilst polystyrene can be seen to have a lower permeability, when used in the production of stoppers, it will generally be foamed such that there are voids present through which the oxygen can pass.

Various suggestions have been made in an attempt to address the problems of oxygen passing through or around the closure. For natural cork stoppers, it has been proposed to use wax plugs on the top of the cork once it is in situ. However, these plugs are normally added for aesthetic considerations.

In WO 96/34806 it has been suggested that the end of the cork should be coated with a polyurethane varnish or paint. In EP 629659 a barrier made of a semi-permeable material such as that sold under the trade mark Gore-tex is applied to regulate the amount of oxygen which passes through the stopper. A gas vent is included within the body of the stopper to further facilitate oxygen regulation. In DE 3940461 a stopper is described in which an aluminium barrier layer is included in the body of the stopper. In DE 4225092 a plastics stopper is described in which a layer comprising ethylene-vinyl alcohol copolymer coated on each side with polyethylene is located within the body of the stopper to provide a degree of imperviousness.

There are a number of materials which are known to be good oxygen barrier materials. However, in general, these materials have properties, such as low elasticity, brittleness, bonding problems, which render them unsuitable for use in connection with stoppers. For example, many high oxygen barrier materials are crystalline and hence non-elastic. Others are stretchable but have little or no recovery and are thus deformed when stretched. Thus such materials would be unsuitable for use in connection with stoppers since they would not have the required elasticity to survive the stopper being forced into, for example, the neck of a bottle.

Some materials are classified as having good gas-barrier capabilities. However, they do not have the high level of gas-barrier properties required and as such if used require that a relatively thick layer of the barrier material to be used which can be unsightly. Typical materials in this category are polymers based on polyethylene or polypropylene which may include other large molecules such as butadiene rubber in an attempt to eliminate the spaces between the polymer chains through which the oxygen can pass. Whilst this greatly reduces the passage of oxygen, it does not eliminate it completely. A further drawback of these materials is that the incorporation of these additional molecules within the polymers tends to reduce their elasticity, which makes them unsuitable for use as the main constituent of synthetic stoppers. An example of a material of this kind is Oxylon CS25, which is produced by DS Chemie. The Mocon oxygen transmission rate for Oxylon CS25 is 500 $cm^3$ though a 100 micron sheet per square metre per day. Such materials are flexible and have a degree of elastic ability but wrinkle when compressed.

Similarly, reactive hot melt polyolefins are moderately high barrier materials but are relatively rigid when set.

There is a considerable number of other high oxygen barrier plastics materials including ethyl vinyl alcohol (EVOH), polyvinylidene chloride (PVDC), and PTFE. These typically have barrier properties of between 3 and 6 $cm^3\ m^{-2}day^{-1}$ for a 25 micron thickness.

There are also non-polymeric high barrier materials such as metal foils, vacuum deposited metals, metal oxides, and other oxides such as silicon oxide. The latter three are vacuum deposited onto substrates such as polyethlyenes to make gas proof bags for food preservation. The aluminium oxide has a barrier property of 0.5 $cm^3\ m^{-2}day^{-1}$day for a 12 micron deposit. However, these materials are difficult to bond to the stoppers and, although they are elastic, have poor resilience.

In summary, no coatings are currently known to exist which provide high levels of gas impermeability combined with elasticity, good adhesion, and the capability of being used in contact with food.

Thus whilst the proposals of the prior art go some way to addressing the problems associated with oxygen passage, there is still a need for an improved stopper which has the desired level of impermeability and which preferably additionally is cost-effective to manufacture, readily installed in use and which is not unsightly. In particular it is desirable to provide these features using very thin films of the order of up to 100 microns.

The problems of the known arrangements may be overcome by the use of a stopper having a barrier layer formed from a hot melt polymeric adhesive.

Thus according to a first aspect of the present invention there is provided a stopper comprising a barrier layer which comprises a hot melt polymeric adhesive.

The barrier layer of the present invention preferably has a permeability of less than about 200 $cm^3m^{-2}day^{-1}$, more preferably less than about 50 $cm^3\ m^{-2}day^{-1}$, more preferably less than about 30 $cm^3m^{-2}day^{-1}$ and most preferably from substantially 0 to about 2 $cm^3m^{-2}day^{-1}$. In the present context, high impermeabilities may involve a permeability rate as low as 2 $cm^3m^{-2}day^{-1}$ which equates to a net rate through the barrier layer of about 0.008 $cm^3day^{-1}$.

The barrier layer preferably has a thickness of from about 0.05 to about 1001 microns, more preferably of from about 0.075 to about 50 microns and most preferable from about 0.1 to about 30 microns. A barrier layer thickness of about 25 microns is particularly preferred. With films having a thickness substantially greater than 100 microns there is a tendency for strong forces to develop within them such that they will have a tendency to separate from the stopper. In particular when under compression, such as is required when inserting a stopper into a bottle, the thicker films, ie thicker than 100 microns, may have a tendency to wrinkle up.

It is surprising that the use of the barrier layer of the present invention with these very low thicknesses will provide the levels of impermeability required. Further, it would be expected that the thin films of the present invention could not be located at the end of the stopper since it would be expected that the film would be fragile such that damage would occur during insertion. However, surprisingly, the films of the present invention withstand the rigours of insertion.

The hot melt polymeric adhesive is preferably a hot melt polyurethane adhesive or a hot melt polyolefin adhesive. Reactive hot melt polyurethanes are formed by mixing two components in situ namely the isocyanate solution and the polyol solution. This is in contrast to the polyurethanes of the prior art in which the polyurethane is preformed and then dissolved in a solvent for application. The polyurethane may be formed from any suitable isocyanate and any suitable polyol. The isocyanate may be an aromatic isocyanate or an aliphatic isocyanate, with aliphatic isocyanates being preferred. The polyol is preferably a polyester polyol or an acrylic polyol.

In use, the isocyanate and the polyol are mixed to form a polyurethane pre-polymer. This pre-polymer is melted such that it is spreadable and is then applied to the surface on which the barrier layer is to be located. The pre-polymer then cures in the presence of heat and water in the atmosphere such that cross-linking occurs. The curing step is irreversible. The resultant polymer is very stable and has a low level of free monomers which could otherwise taint the material to be stored in the receptacle.

Thus according to a second aspect of the present invention there is provided a method of applying the barrier layer comprising a polyurethane hot melt adhesive to a stopper in which a pre-polymer is formed by combining an isocyanate solution with a polyol solution, the pre-polymer is applied to a surface of the stopper and the pre-polymer is allowed to cure.

Where the hot melt adhesive is a polyolefin, any suitable polyolefin may be used with polyethylene being particularly preferred.

The hot melt adhesives of the present invention bond well to the closures of the present invention.

In general reactive hot melt adhesives are flexible but relatively inelastic when set. However, it has been found that when they are stretched or compressed they become more elastic. This elasticity means that the barrier layer will move with the stopper such that an improved seal between the stopper and the receptacle into which the stopper is to be placed is achieved. In addition, it is believed that the close bonding between the barrier layer and the layer of the reactive hot melt adhesive results in the elasticity of the material of the stopper being transferred into or induced in the reactive hot melt adhesive.

The elasticity of the barrier layer of the present invention provides an additional benefit since it may force the part of the stopper to which the layer is attached outwardly such that the seal with the wall of the receptacle is enhanced. This property may be further utilised by extending the barrier layer beyond the edge of the closure. In use, the extended barrier layer will form a gasket with the inner wall of the receptacle and thereby prevent gas flow between the stopper and the wall of the receptacle. The barrier layer preferably extends beyond the edge of the stopper by up to about 200 microns. In a preferred arrangement it may extend by about 30 microns. Since the barrier layer will usually be formed of a denser and tougher material than that from which the stopper is formed, the gasket will exert a considerable extra force on the wall of the receptacle over a small area thereby providing a strong seal. This is particularly desirable where the closure is coated on the surfaces which are to come into contact with the walls of the receptacle with lubricant, such as silicone lubricants or paraffin wax to ensure smooth insertion and extraction of the stopper.

The barrier layer of the present invention may include additives For example, metal oxides, such as iron oxide, aluminium oxide and the like may be included to enhance the oxygen barrier properties of the layer. Similarly other additives may be included such as finally divided silicon, powdered PTFE, clays, oxygen scavengers and the like.

The stopper will usually be cylindrical in shape such that it has two faces. The hot melt adhesive layer may be located at either or both of the faces. The main advantage of locating a barrier layer on each of the faces of the stopper is that in use, there will be no requirement for the user, e.g. the bottler, to have to select a particular orientation for the stopper since the stopper will have both layers present. Where the stopper is shaped, such as for example, in the case of the corks used for champagne bottles, the barrier layer will normally be provided to the face of the stopper which is to be located within the receptacle. Locating the barrier at the face of the stopper has the advantage that the integrity of the stopper is not compromised such that the risk of breakage at the point of any join is obviated.

In one alternative arrangement, the barrier layer may be located within the body of the stopper. Where the barrier layer is located within the stopper, the barrier layer will preferably be located substantially parallel to one of the faces of the stopper.

The barrier layer will preferably extend across the entire face or cross-section of the stopper such that a continuous barrier is provided. However, where required, it may be applied to only a portion of the face or cross-section such that an improvement to permeability is achieved without providing a total barrier.

Where the barrier layer is located within the body of the stopper, the two parts of the stopper either side of the barrier layer will be bonded to the barrier layer. In this arrangement, the pre-polymer may be applied onto one part of the stopper and then the second part placed in contact with the melted pre-polymer such that at the point of curing the two parts are bonded together. Locating the barrier within the stopper in this manner has certain advantages. For example, if the barrier layer is visually distinct from the stopper, locating it within the body of the stopper may make it less obtrusive.

The barrier layer may be a composite layer comprising at least one hot melt polymeric adhesive sub-layer and at least one sub-layer having lower oxygen permeability than the hot melt adhesive. The barrier layer may include a plurality of layers and barrier layers comprising between 10 and 20 layers may be useful. In one arrangement, one layer in a multiple layered barrier layer may be or may include an oxygen scavenger material.

Where multiple sub-layers are present in the barrier layer, a hot melt adhesive sub-layer will preferably be located against the material of the stopper. Thus where the barrier layer is located within the body of the stopper, a sub-layer of hot melt adhesive may be located between each part of the stopper and the low permeability sub-layer.

However, in some arrangements, the lower permeability material sub-layer may be located against the stopper and may be applied and bonded to the material of the stopper by any suitable means including by heat fusion, spraying in a suitable solvent, incorporating in the mould during the production of the stopper, physical bonding, chemical bonding, vapour deposition, or by being applied in molten form by printing or rolling. Where the material can be applied as a liquid it may be applied by any suitable means including direct application, brushing, printing, spraying or dipping.

Where the lower permeability material is not suitable for contact with food substances, the hot melt adhesive sub-layer will generally be provided as the outer layer such that it is this that will come in contact with the contents of the receptacle into which the stopper is placed.

By the use of a multiple layer barrier layer, any difficulties and drawbacks of the material in one sub-layer may be compensated for in one or more of the others. For example, low permeability layers, which have adhesive problems to the material of the stopper, may be successfully bonded to the stopper using a hot melt adhesive sub-layer. Further, a low permeability sub-layer having low elasticity properties may be aided in this regarded by the improved elasticity of the hot melt adhesive sub-layer. Thus the more powerful elastic response of the hot melt adhesive combined with its strong adhesive properties provides the barrier layer as a whole with these properties and thereby forces the low permeability sub-layer to conform with the movements of the hot melt adhesive sub-layer. This means that the chance of fracture of the low permeability sub-layer, which may be brittle, is reduced. Further, if fracture does occur in the low permeability sub-layer, its extent may be reduced since the hot melt adhesive sub-layer may prevent the propagation of the fracture or where the fracture extends across the barrier layer, may hold the pieces of the low permeability sub-layer in place.

Any suitable lower permeability material may be used in the production of the sub-layer. Examples include metal foils and vacuum deposited metals. Where metals are used, the presence of the hot melt adhesive sub-layer can address the problems normally experienced with such materials of wrinkling of the foils or problems in the integrity of the vacuum deposited metal films under stretching or compression. The problems associated with metals contaminating, e.g. wine, can also be overcome by the present invention where the metal sub-layer can have a coating of the hot melt adhesive sub-layer on the outer surface of the barrier layer or the barrier layer may be located within the body of the stopper.

Alternative lower permeability material include ethylene vinyl alcohol copolymers polyvinylidene chloride and polyethyleneterephthalate.

Thus according to a further aspect of the present invention there is provided a composite barrier layer for use with a stopper comprising at least one hot melt adhesive sub-layer and at least one sub-layer having lower permeability than the hot melt adhesive.

The multiple layered barrier layer of one embodiment of the present invention may be formed by any suitable means. For example, where the low permeability sub-layer is a self-supporting material such as a metal foil, one of the sub-layer and the stopper is coated with the hot melt adhesive. It may be desirable to coat the stopper since this is mechanically firm. However, in some arrangements it is desired to coat the film. The hot melt adhesive will normally be allowed to cool and harden before the film and stopper are brought together.

Where the barrier layer comprises a plurality of layers a film of the barrier material may be pre-formed, less an outer layer of hot melt adhesive. This may then be treated with the hot melt adhesive to form the hot melt adhesive sub-layer before being applied to the stopper. Alternatively, the stopper may be treated with the hot melt adhesive and the pre-formed material applied.

Where the above-mentioned methods are used, the film, having been applied to the stopper is preferably held in tension and the stopper pushed into it, usually with a cup, preferable a silicone cup, located behind the film to shape the film securely to the stopper. The stopper may be pre-heated to activate the hot melt layer or the silicone cup, if present, may be heated. The use of a cup is particularly useful when the barrier layer is to be applied to stoppers having a round or bevelled face. The tension of the film together with the shaping of the cup causes the film to be shaped round the curved face such that it is firmly adhered.

The process of this arrangement is particularly advantageous in achieving a good seal around the edges of the stopper. A good seal is particularly desirable since in its absence there is a danger of moisture penetrating the interface between the barrier layer and the stopper such that a reduction in impermeability would be noted.

The stopper of the present invention is preferably a stopper for a bottle, most preferably a wine bottle. The stopper may be made of cork or plastics material. The stopper may be made of a combination of materials. For example, it may be formed predominantly of cork but include a disk of plastics material.

It may be desirable to activate the stopper prior to the application of the film. Activation may be achieved by any suitable means including corona discharge.

Where the stopper is made of cork, the barrier of the present invention will, in addition to providing improved impermeability to oxygen, also act as a barrier to microbiological contaminants such as cork-taint, for example, trichloroanisole (TCA) and yeasts which contaminate wine, as well as acting as a barrier to chemicals in the cork from entering the wine such as tannins and tars.

It is known that plastics stoppers have an advantage in that they can remove TCA from wine. However, if the barrier layer is located at the face of the stopper which will be in contact with wine, the ability to remove the contaminants will be removed unless the barrier layer is a polyolefin adhesive or in a multiple layer system includes a polyolefin as the outer sub-layer. To overcome this problem, the barrier layer may be located within the stopper or at the face of the stopper removed from contact with the wine such that it is stopper material which is contact with the wine. In one alternative, the barrier layer may be left in contact with the wine but coated with a further sub-layer of polyolefin, such as polyethylene, which will remove the TCA.

Similarly, where the wine may be already contaminated, and natural cork is to be used as the stopper, the barrier layer of the present invention will preferably be located at the face of the stopper in contact with the wine and a coating of polyolefin, such as polyethylene, will be provided which will remove the TCA from the wine.

The polyolefin outer sub-layer may be of any suitable thickness. In one arrangement, it has a thickness of up to about 10 microns.

Thus in a most preferred arrangement, the barrier layer of the present invention provides a three component layer located at the end of the stopper in contact with the wine. The three component layer comprising a polyolefin adhesive in contact with the stopper, a lower permeability sub-layer such as an ethylene vinyl alcohol copolymer and an outer sub-layer of polyolefin such as polyethylene.

In one arrangement of the present invention, the barrier layer of the present invention may allow some oxygen to pass through the barrier since this may be desirable, for example in the maturing of wine. However, by the selection of the barrier layer, it may be possible to control the level of oxygen allowed through. Amounts in the region of from about 0.00001 $cm^3m^{-2}day^{-1}$ to about 0.001 $cm^3m^{-2}day^{-1}$ may be desirable. Thus by careful selection of the material, the oxygen ingress can be controlled. Where the barrier is selected to allow some oxygen ingress, it will preferably also be selected such that it is substantially impermeable to microbiological contaminants.

Based on aesthetic considerations, the barrier layer may be coloured to resemble cork or may be transparent or translucent.

Figure 2:
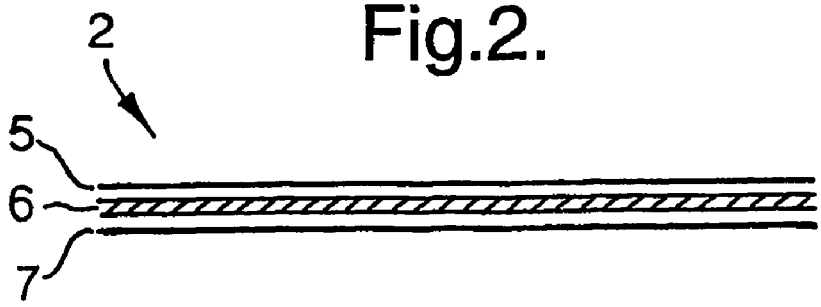

The present invention will now be described, by way of example, with reference to the accompanying drawings in which:

FIG. 1 is a schematic illustration of stopper including a barrier layer of one embodiment of the present invention; and FIG. 2 is a cross-section through a preferred barrier film of the present invention.

As illustrated in FIG. 1, the stopper 1 is generally cylindrical having a proximal face 2 which in use will be in contact with the wine. The proximal face has applied thereto a barrier layer 3. As illustrated, the distal face 4 is not provided with the barrier layer but it will be understood that a barrier layer may be provided on this face. The stopper may have bevelled edges 8.

A cross-section of a typical barrier layer is illustrated in FIG. 2. The barrier layer comprises three sub-layers. In the illustrated arrangement, the sub-layers are respectively a polyethylene sub-layer 5, a lower permeability sub-layer of ethylene vinyl alcohol copolymer 6 and an outer sub-layer of polyethylene 7.

A film of the present invention as illustrated in FIG. 2 was applied to a plastics cork and the resultant stopper tested using Mocon oxygen permeability rate equipment. The stopper was inserted into a bottle having two small copper pipes inserted in the bottom, oxygen was circulated though one tube and out through the other. The change in composition was measured using the Mocon equipment. The change in composition was due to oxygen permeating through the corks. The results are set out in Table 1. Two tests were carried out and are identified as Replicate 1 and 2. The experiment was then repeated using the plastics stopper without the barrier layer of the present invention and the results are set out in Table 1.

TABLE 1

| | Replicate 1 | Replicate 2 | Average |
|---|---|---|---|
| Plastics stopper + barrier layer | 0.005 | 0.0017 | 0.00335 |
| Plastics stopper | 0.0175 | 0.031 | 0.024 |

All values are at $cm^3$/stopper/24 hours.air

It can therefore be seen that the present invention provided an average improvement of a factor of 7.24

The invention claimed is:

1. A stopper comprising a cork substrate and a barrier layer, said barrier layer being a composite layer comprising at least one reactive hot melt polyurethane adhesive sub-layer and at least one sub-layer having lower oxygen permeability than the reactive hot melt adhesive, wherein at least one of said reactive hot melt polyurethane adhesive sub-layers being located against the cork substrate and wherein said barrier layer has a thickness of from 2 to 100 microns.

2. A stopper according to claim 1, wherein the barrier layer includes one or more additives.

3. A stopper according to claim 1, wherein the stopper is cylindrical in shape and has two faces located at the ends of the cylinder.

4. A stopper according to claim 3 wherein at least one face is rounded or bevelled.

5. A stopper according to claim 3 wherein the barrier layer is located at either or both of the faces.

6. A stopper according to claim 3, wherein the barrier layer is located within the body of the stopper and substantially parallel to at least one of the faces of the stopper.

7. A stopper according to claim 1, wherein the barrier layer extends across the entire face or cross-section of the stopper such that a continuous barrier is provided.

8. A stopper according to claim 1, wherein the barrier layer extends across only a portion of the face or cross-section.

9. A stopper according to claim 1, wherein the barrier layer extends beyond the face or cross-section of the stopper to form a gasket.

10. A stopper according to claim 1 wherein the lower oxygen permeability sub-layer is an ethylene vinyl alcohol copolymer.

11. A stopper according to claim 1, wherein the stopper is a stopper for a bottle.

12. A stopper according to claim 11 wherein the bottle is a wine bottle.

13. A stopper according to claim 11 wherein the stopper is made of cork or plastics material.

14. A stopper according to claim 1, wherein the barrier layer will additionally provide a barrier to microbiological contaminants.

* * * * *